US012150501B2

(12) United States Patent
Wong

(10) Patent No.: US 12,150,501 B2
(45) Date of Patent: Nov. 26, 2024

(54) LEG GUARD WITH DETACHABLE SHIN-CAP EXTENSION

(71) Applicant: Easton Diamond Sports, LLC, Thousand Oaks, CA (US)

(72) Inventor: Allan Wong, Hong Kong (HK)

(73) Assignee: EASTON DIAMOND SPORTS, LLC, Thousand Oaks, CA (US)

( * ) Notice: Subject to any disclaimer, the term of this patent is extended or adjusted under 35 U.S.C. 154(b) by 20 days.

(21) Appl. No.: 17/228,322

(22) Filed: Apr. 12, 2021

(65) Prior Publication Data

US 2022/0322762 A1 Oct. 13, 2022

(51) Int. Cl.

| | |
|---|---|
| ***A41D 13/05*** | (2006.01) |
| ***A41D 13/06*** | (2006.01) |
| *A63B 71/12* | (2006.01) |

(52) U.S. Cl.

CPC ..... *A41D 13/0543* (2013.01); *A41D 13/065* (2013.01)

(58) Field of Classification Search

CPC ..... A63B 71/1225; A63B 2071/125; A63B 2071/1258; A63B 2071/1283; A63B 2102/18; A63B 2102/182; A63B 2209/10; A63B 2225/09; Y10T 24/45241; Y10T 24/45215; Y10T 24/45262; A41D 13/065; A41D 13/0543

USPC ..... 2/24

See application file for complete search history.

(56) References Cited

U.S. PATENT DOCUMENTS

| | | | | |
|---|---|---|---|---|
| 6,654,961 | B2 * | 12/2003 | Beland | A63B 71/1225 2/22 |
| 7,426,755 | B2 * | 9/2008 | Grilliot | A62B 17/003 2/81 |
| 7,950,067 | B2 * | 5/2011 | Williams, Jr. | A41D 13/065 2/23 |
| 11,039,664 | B2 * | 6/2021 | Huneau | A43B 23/26 |
| 2004/0209739 | A1 * | 10/2004 | Lammers | A63B 21/012 482/148 |
| 2006/0191110 | A1 * | 8/2006 | Howell | A45F 5/02 24/3.12 |
| 2013/0232654 | A1 * | 9/2013 | Camillo | A41D 13/0512 2/2.5 |

(Continued)

OTHER PUBLICATIONS

Franklin Sports, Soccer shin guard with detachable ankle guard, URL: https://franklinsports.com/field-master-black-shin guards; web page visited Apr. 12, 2021.

*Primary Examiner* — Robert H Muromoto, Jr.
(74) *Attorney, Agent, or Firm* — Perkins Coie LLP

(57) ABSTRACT

Protective equipment for protecting a portion of a user's body (such as a leg guard for protecting part of a user's leg) may include a cap configured to cover a first portion of a user's body and a cap-extension element connected to an end of the cap and configured to cover at least another portion of the user's body. The cap-extension element is removable from the cap and connectable to the cap via an attachment mechanism. The attachment mechanism may include a tab element on the cap-extension element that connects to a socket element on the cap. The protective equipment may include a cap liner attached to the cap, a cap-extension liner attached to the cap-extension element, and the attachment mechanism may include liner-attachment elements on the liners.

19 Claims, 8 Drawing Sheets

(56) References Cited

U.S. PATENT DOCUMENTS

| | | | | |
|---|---|---|---|---|
| 2016/0249692 | A1* | 9/2016 | Guidetti | A41D 13/065<br>2/16 |
| 2017/0055603 | A1* | 3/2017 | Guidetti | A41D 13/0543 |
| 2020/0391096 | A1* | 12/2020 | Gauvin | A41D 13/0543 |

* cited by examiner

LEG GUARD WITH DETACHABLE SHIN-CAP EXTENSION

BACKGROUND

Traditional protective equipment, such as leg guards for baseball or softball, is offered in approximate sizes, such as small, medium, or large, to accommodate different user sizes. Accordingly, traditional protective equipment typically requires several sets of molds or tooling (one for each approximate size).

SUMMARY

Representative embodiments of the present technology include protective equipment for protecting a portion of a user's body (such as a leg guard for protecting part of a user's leg). In some embodiments, protective equipment may include a cap configured to cover a first portion of a user's body and a cap-extension element connected to an end of the cap and configured to cover at least another portion of the user's body. The cap-extension element is removable from the cap and connectable to the cap via an attachment mechanism. The attachment mechanism may include a tab element on the cap-extension element that connects to a socket element on the cap. The protective equipment may include a cap liner attached to the cap, a cap-extension liner attached to the cap-extension element, and the attachment mechanism may include liner-attachment elements on the liners.

Other features and advantages will appear hereinafter. The features described herein can be used separately or together, or in various combinations of one or more of them.

BRIEF DESCRIPTION OF THE DRAWINGS

In the drawings, wherein the same reference number indicates the same element throughout the views.

DETAILED DESCRIPTION

The present technology is directed to protective equipment, such as leg guards, with detachable cap extensions, and associated systems and methods. Various embodiments of the technology will now be described. The following description provides specific details for a thorough understanding and enabling description of these embodiments. One skilled in the art will understand, however, that the invention may be practiced without many of these details. Additionally, some well-known structures or functions, such as those common to protective equipment such as leg guards, may not be shown or described in detail to avoid unnecessarily obscuring the relevant description of the various embodiments. Accordingly, embodiments of the present technology may include additional elements or exclude some of the elements described below with reference to FIGS. 1-8, which illustrate examples of the technology.

The terminology used in this description is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list. Further, unless otherwise specified, terms such as "attached" or "connected" are intended to include integral connections, as well as connections between physically separate components. Numerical adjectives including "first" and "second," as used in the present disclosure, do not convey hierarchy or specific features or functions. Rather, such numerical adjectives are intended to aid the reader in distinguishing between elements which may have similar nomenclature, but which may differ in position, orientation, or structure. Accordingly, such numerical adjectives may be used differently in the claims.

Specific details of several embodiments of the present technology are described herein with reference to leg guards for baseball or softball. Embodiments of the present technology can be used in other sports, such as hockey, or in other industries or activities, or for guards for other anatomy, such as arm guards.

Figure 1:
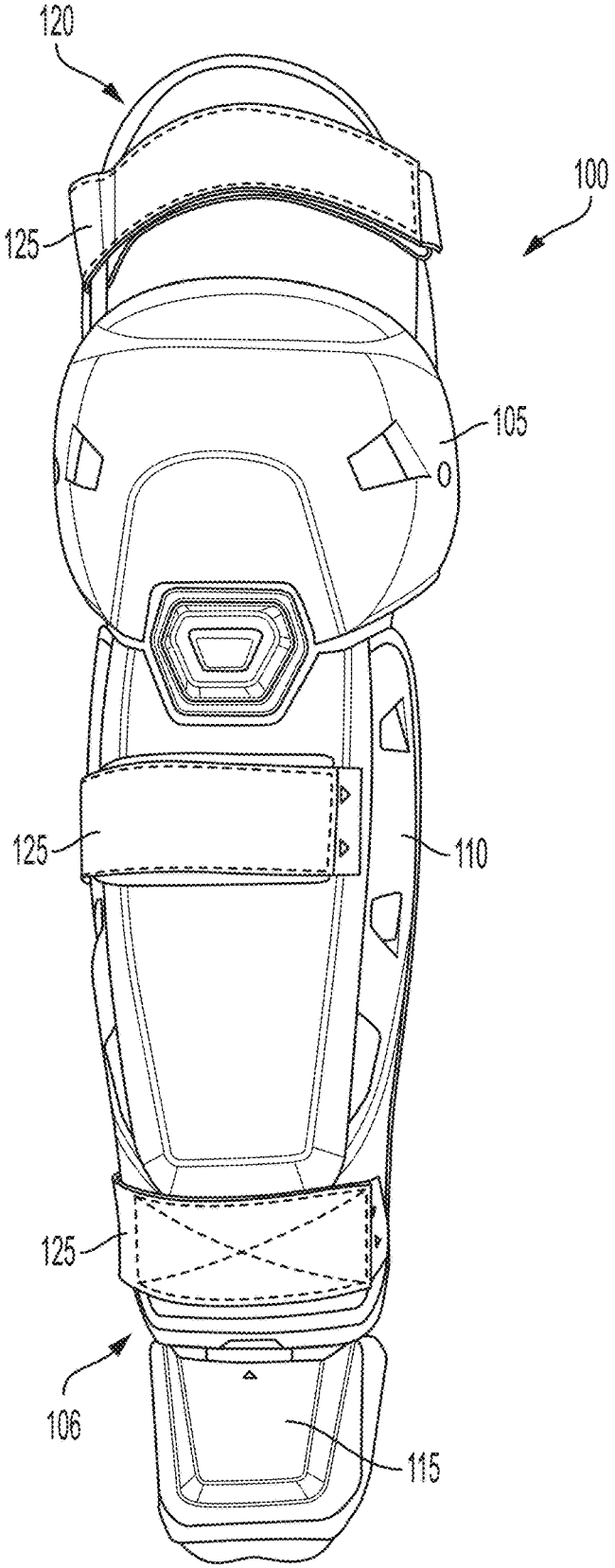
FIG. 1 illustrates an anterior view of a leg guard configured in accordance with embodiments of the present technology.

FIG. 1 illustrates an anterior view of a leg guard 100 configured in accordance with embodiments of the present technology. The leg guard 100 includes a plurality of protective shells or cap portions, such as a knee cap 105 and a shin cap 110. The knee cap 105 is positioned and configured to protect a user's knee. The shin cap 110 is positioned and configured to protect at least a portion of a user's anterior shin region. The leg guard 100 further includes a shin-cap-extension element 115 that is detachably connected to a lower end 106 of the shin cap 110. The shin-cap-extension element 115 is also positioned and configured to protect at least a portion of a user's anterior shin region.

Removal of the shin-cap-extension element 115 shortens the overall length of the leg guard 100 to accommodate a smaller user. Replacement of the shin-cap-extension element 115 increases the overall length of the leg guard 100 to accommodate a larger user. The leg guard 100 may include one or more elements of padding 120 to cushion a user's leg against the harder portions of the leg guard 100, such as the cap portions 105, 110 or the shin-cap-extension element 115, and to further absorb impact energy.

In some embodiments, the knee cap 105 and the shin cap 110 articulate relative to each other via a suitable mechanism, such as a hinge, or as a result of their mutual connection to the padding 120. The leg guard 100 may include one or more body retention elements 125 (such as straps) to secure the leg guard 100 on a user's leg. In FIG. 1, the straps 125 are in a closed configuration, demonstrating their position while a user wears the leg guard 100.

Figure 2:
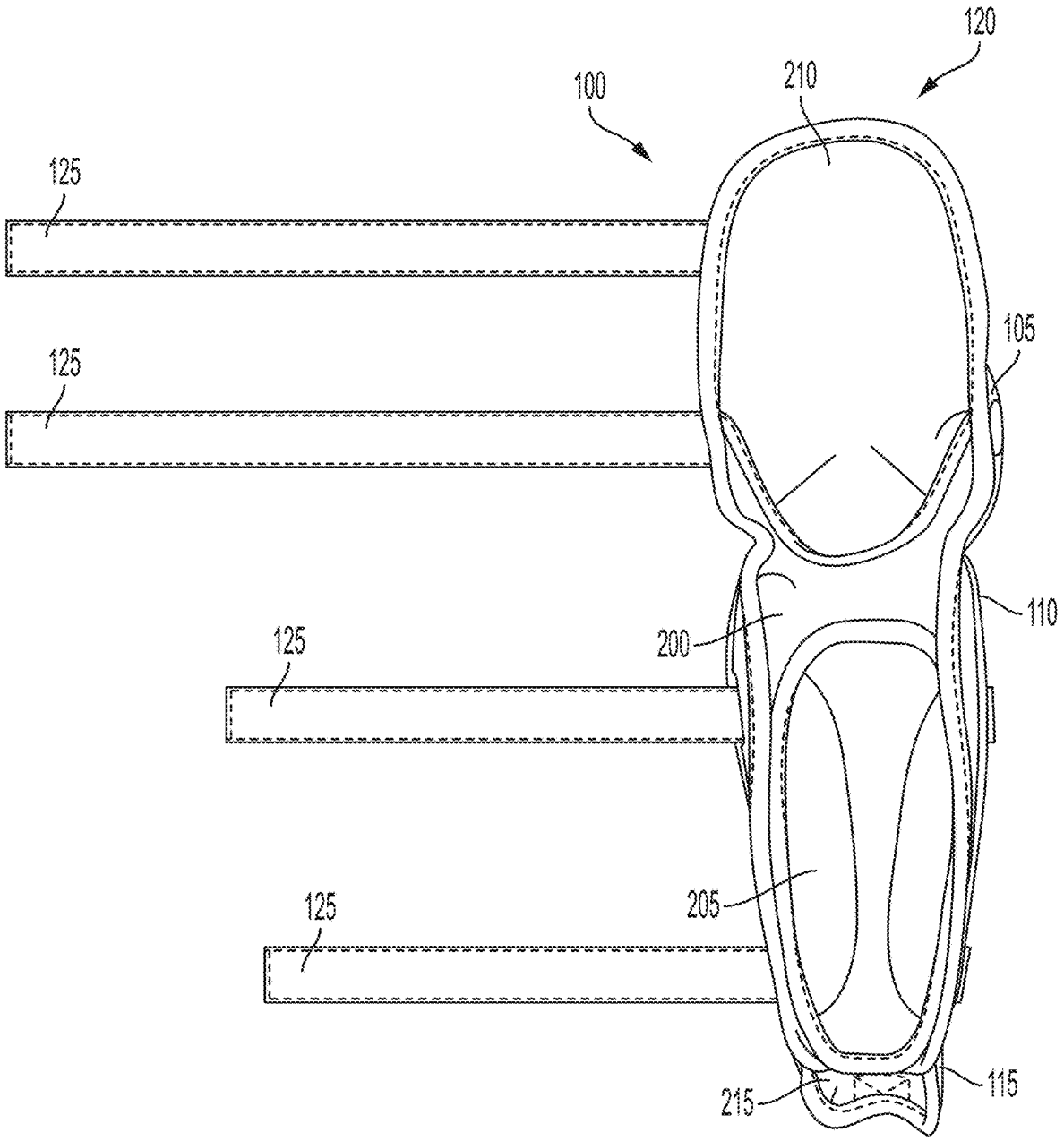
FIG. 2 illustrates a posterior view of the leg guard shown in FIG. 1.

FIG. 2 illustrates a posterior view of the leg guard 100. In FIG. 2, the straps 125 are in an open position to demonstrate a view of the leg guard 100 prior to a user donning it. In some embodiments, the padding 120 includes a flexible shin-cap liner 200 that is attached to the shin cap 110 via stitching, adhesive, rivets, or another suitable form of attachment. The shin-cap liner 200 may also be attached to the knee cap 105 via stitching, adhesive, rivets, or another suitable form of attachment.

In some embodiments, the shin cap 110 and the knee cap 105 are separate components attached to the shin-cap liner 200, which may facilitate articulation between the shin cap 110 and the knee cap 105. The padding 120 may further include a shin pad 205 attached to the shin-cap liner 200 and positioned to coextend with at least part of a user's shin area for additional cushion. The padding 120 may also include a knee pad 210 attached to the shin-cap liner 200 and positioned to coextend with at least part of a user's knee for additional cushioning. The padding 120 may further include a shin-cap-extension liner 215 that is attached to the shin-cap-extension element 115 via stitching, adhesive, rivets, or another suitable form of attachment.

FIGS. 1 and 2 show the leg guard 100 inclusive of the shin-cap-extension element 115. In such a configuration, the leg guard 100 may be used on a player with relatively longer legs. The additional length provided by the shin-cap-extension element 115 protects the lower region of the player's longer legs.

Figure 3:
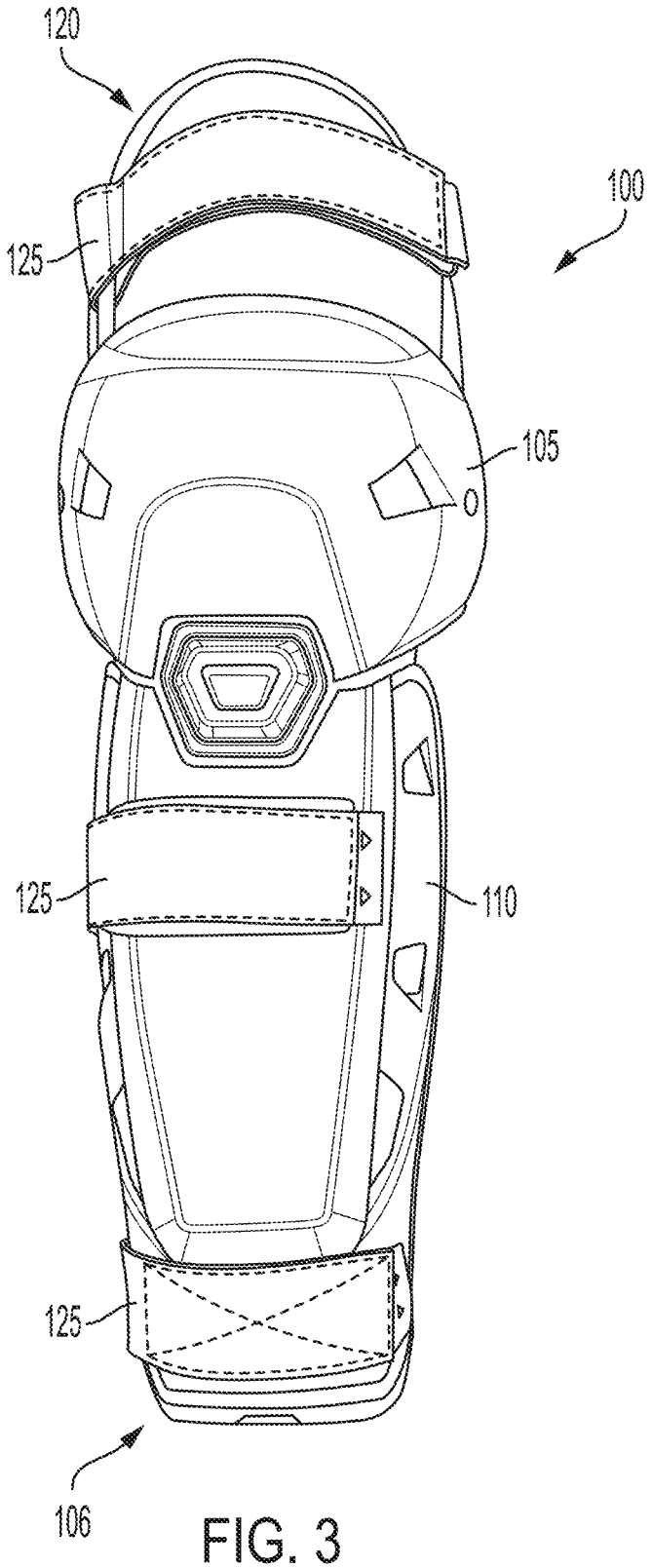
FIG. 3 illustrates an anterior view of the leg guard shown in FIG. 1, with a shin-cap extension removed.

FIG. 3 illustrates an anterior view of the leg guard 100 with the shin-cap-extension element 115 removed. When the shin-cap-extension element 115 is removed, the leg guard 100 accommodates a player with relatively shorter legs.

Figure 4:
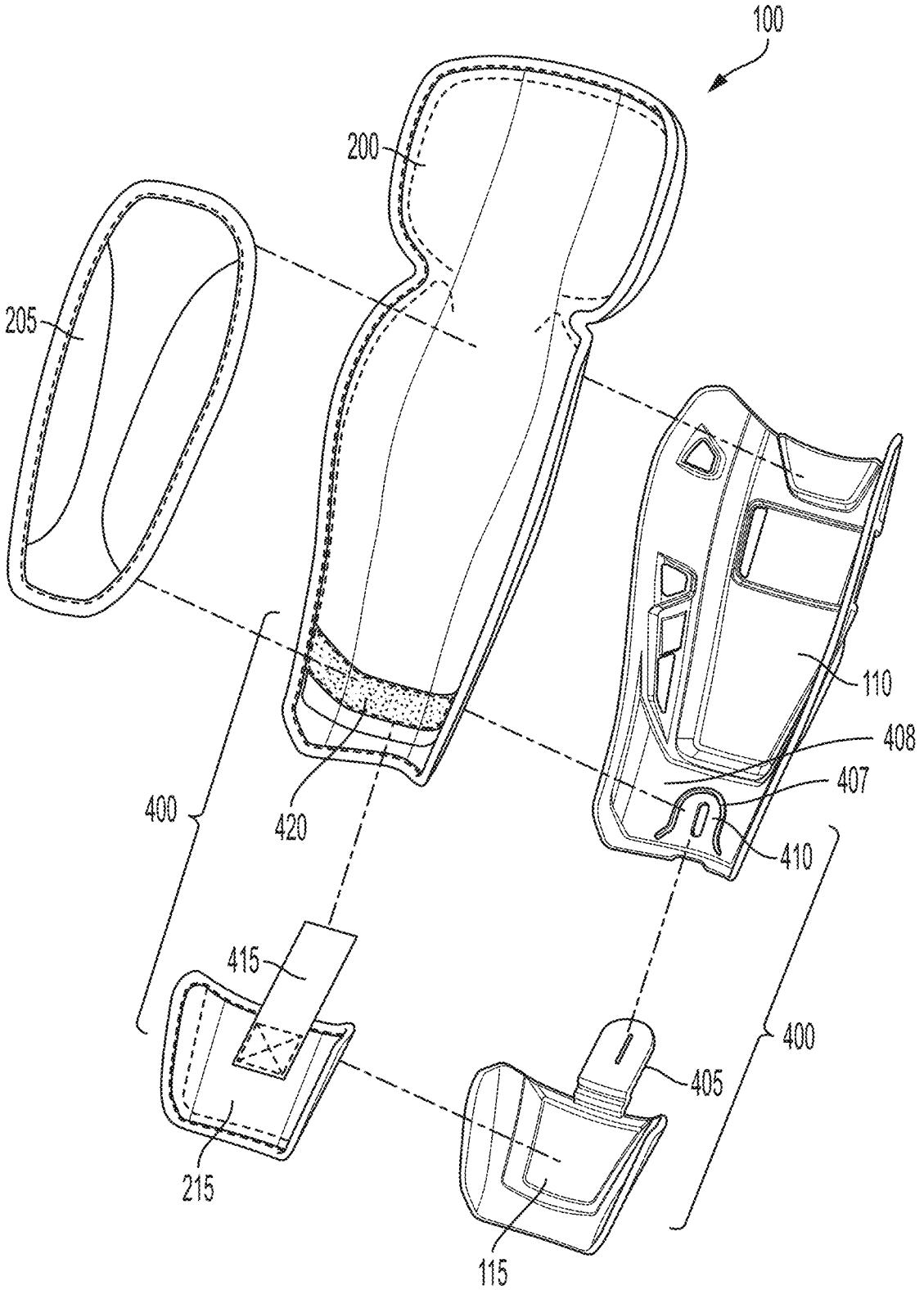
FIG. 4 illustrates a posterior isometric exploded view of portions of the leg guard shown in FIG. 1.

FIG. 4 illustrates a posterior isometric exploded view of portions of the leg guard 100. The leg guard 100 includes a releasable attachment mechanism 400 for detachably connecting (removably and replaceably connecting) the shin-cap-extension element 115 to the shin cap 110, in accordance with embodiments of the present technology. In some embodiments, the attachment mechanism 400 includes a first cap-attachment element 405 connected to or integral with the shin-cap-extension element 115 and configured to engage a second cap-attachment element 410 of the shin cap 110. In addition to the cap-attachment elements 405, 410, or alternative to the cap-attachment elements 405, 410, the attachment mechanism 400 may include a first liner-attachment element 415 connected to or integral with the shin-cap-extension liner 215 and configured to engage a second liner-attachment element 420 of the shin-cap liner 200.

In use, when the first cap-attachment element 405 is engaged with the second cap-attachment element 410, or when the first liner-attachment element 415 is engaged with the second liner-attachment element 420, the shin-cap-extension element 115 is attached to the shin cap 110. When the attachment elements 405, 410, 415, 420 are disengaged, the shin-cap-extension element 115 is disconnected from the shin cap 110.

In some embodiments, and as generally illustrated in FIG. 4, the first cap-attachment element 405 may be in the form of a tab element extending from the shin-cap-extension element 115. The shin cap 110 may include the second cap-attachment element 410 in the form of a socket for receiving the tab element (the first cap-attachment element 405). In some embodiments, the second cap-attachment element 410 (for example, the socket) may be formed by a contoured wall element 407 projecting in a posterior direction from a posterior surface 408 of the shin cap 110. The first cap-attachment element 405 may slide into, snap into, click into, or otherwise engage the second cap-attachment element 410. Engagement between the cap-attachment elements 405, 410 is described in additional detail below. In other embodiments, the shin cap 110 may include a tab element and the shin-cap-extension element 115 may include the corresponding socket.

In some embodiments, the first liner-attachment element 415 and the second liner-attachment element 420 may be hook and loop fasteners (such as VELCRO® hook and loop material). For example, the first liner-attachment element 415 may include a strip of hook material and the second liner-attachment element 420 may include a strip of loop material, or vice versa. The shin pad 205 may be connected to the shin-cap liner 200 in a manner that leaves the second liner-attachment element 420 exposed to facilitate access to the connection point between the liner-attachment elements 415, 420. In some embodiments, the attachment mechanism 400 may include other attachment elements for connecting the shin-cap-extension element 115 to the shin cap 110, such as snaps, buttons, clasps, or other suitable attachment elements.

Figure 5:
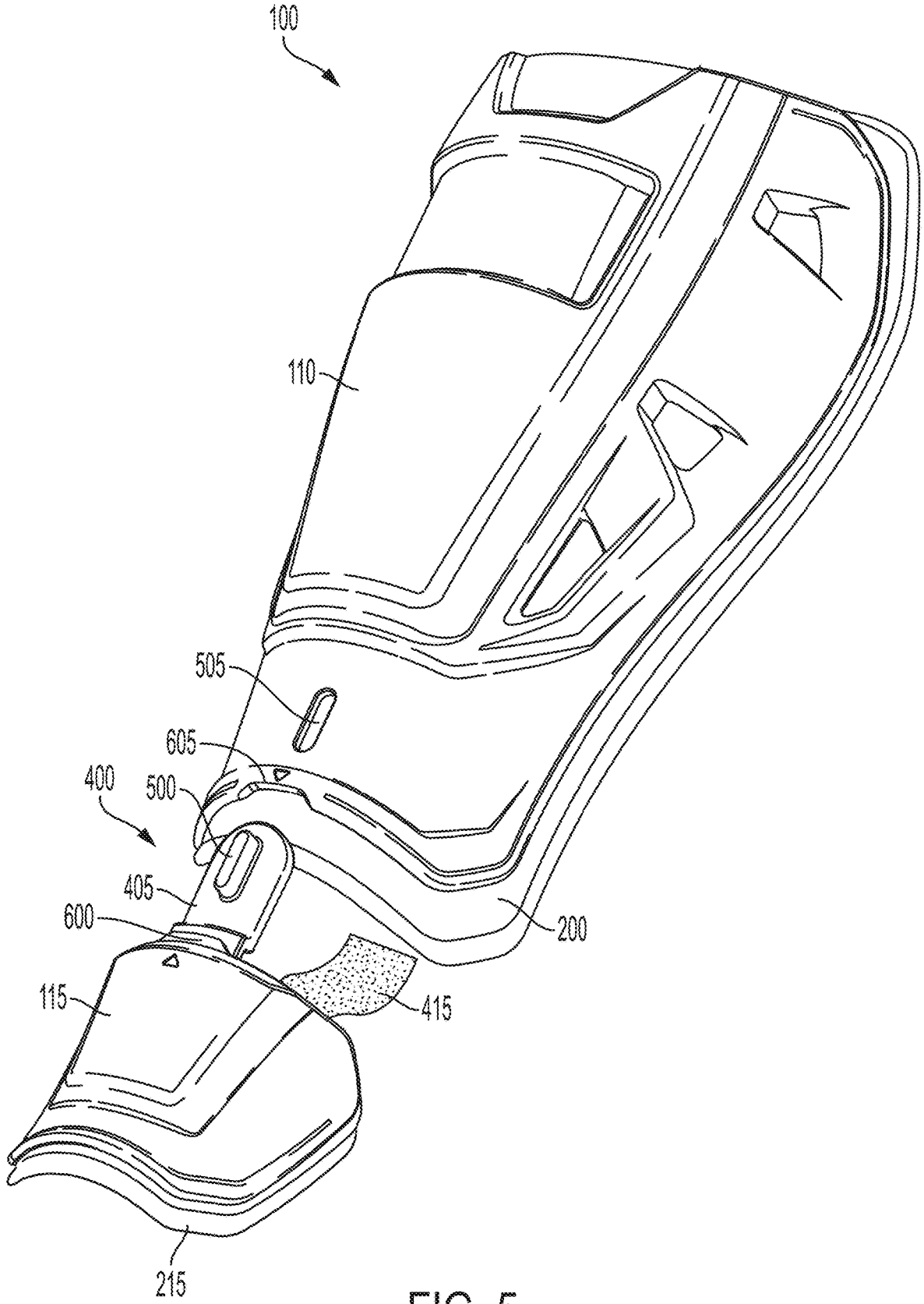
FIG. 5 illustrates an anterior and lateral isometric view of portions of the leg guard shown in FIG. 1 in a disassembled state, in which the shin-cap extension is about to be connected to the shin cap, or in which the shin-cap extension has just been disconnected from the shin cap.

FIG. 5 illustrates an anterior and lateral isometric view of portions of the leg guard 100 in a disassembled state, in which the shin-cap-extension element 115 is about to be connected to the shin cap 110. In some embodiments, the first cap-attachment element 405 is positioned between the shin-cap liner 200 and the shin cap 110 when it is engaged with the second cap-attachment element 410 (not visible in FIG. 5, see FIGS. 4 and 7).

In some embodiments, the first cap-attachment element 405 includes a boss 500 or similar component projecting in an anterior direction. The shin cap 110 may include a corresponding opening 505 for receiving the boss 500. The opening 505 may extend partially or fully through the thickness of the shin cap 110 (from the inside of the shin cap 110 in embodiments where it does not pass fully through the thickness). The boss 500 may slip into or snap into the opening 505. The first liner-attachment element 415 may attach to the shin-cap liner 200 on a posterior side of the shin-cap liner 200.

Figure 6:
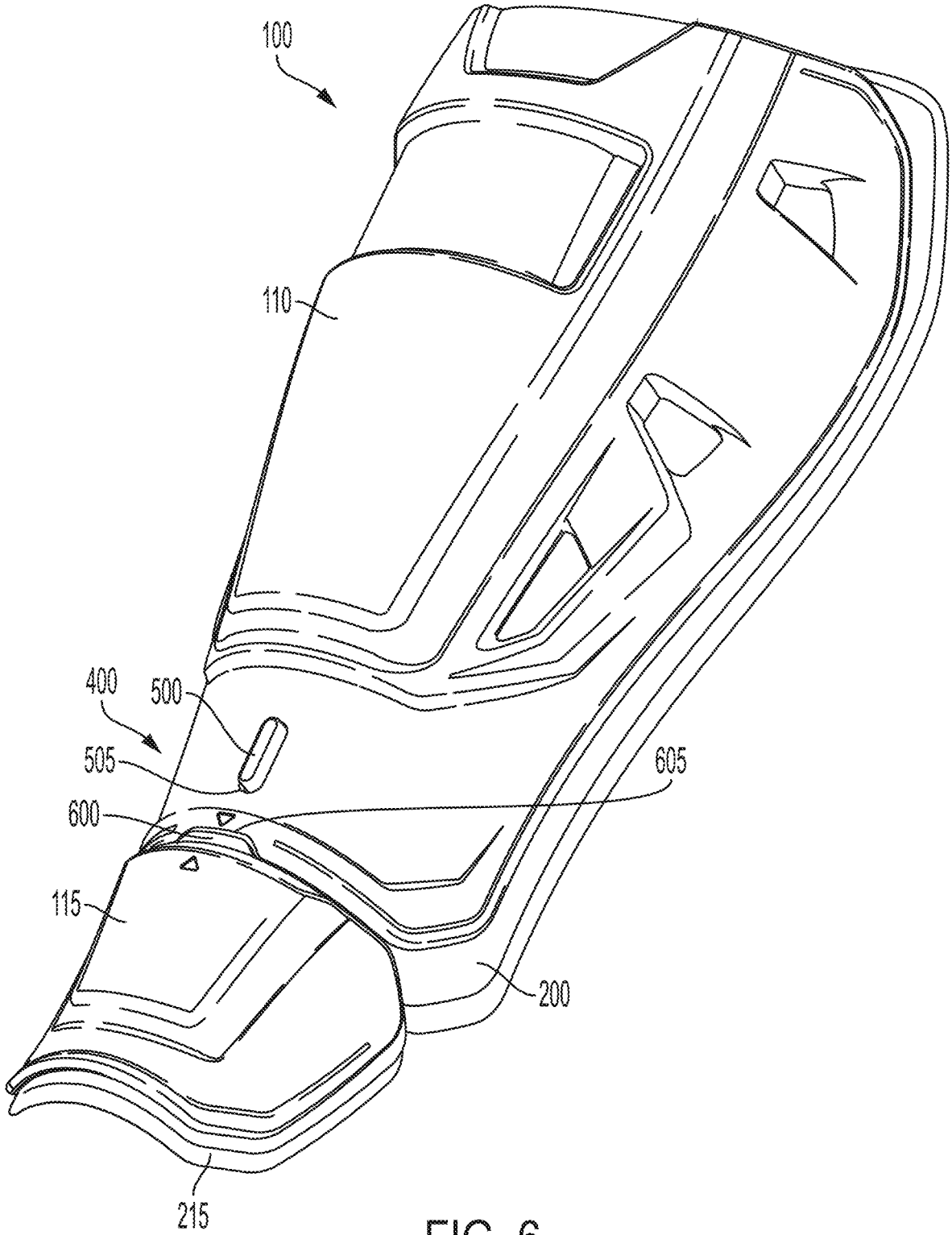
FIG. 6 illustrates an anterior and lateral isometric view of portions of the leg guard shown in FIG. 1 in an assembled state, in which the shin-cap extension is connected to the shin cap.

FIG. 6 illustrates an anterior and lateral isometric view of portions of the leg guard 100 in an assembled state, in which the shin-cap-extension element 115 is connected to the shin cap 110. In FIG. 6, the boss 500 is positioned in the opening 505. The remainder of the first cap-attachment element 405 is generally not visible in FIG. 6, as it is sandwiched between the shin-cap liner 200 and the shin cap 110.

In some embodiments, as shown in FIG. 1, a strap 125 may cover the anterior portion of the boss 500 and the opening 505. The straps 125 are omitted from FIG. 6, however, to show the features of the caps 110, 115. In some embodiments, the shin-cap-extension element 115 includes a contoured projection 600 shaped to engage a corresponding contoured notch 605 on the shin cap 110 to nest the shin-cap-extension element 115 with the shin cap 110. In some embodiments, the shin-cap liner 200 overlaps the shin-cap-extension liner 215 such that the shin-cap-extension liner 215 is positioned between the shin-cap liner 200 and the shin-cap-extension element 115.

Figure 7:
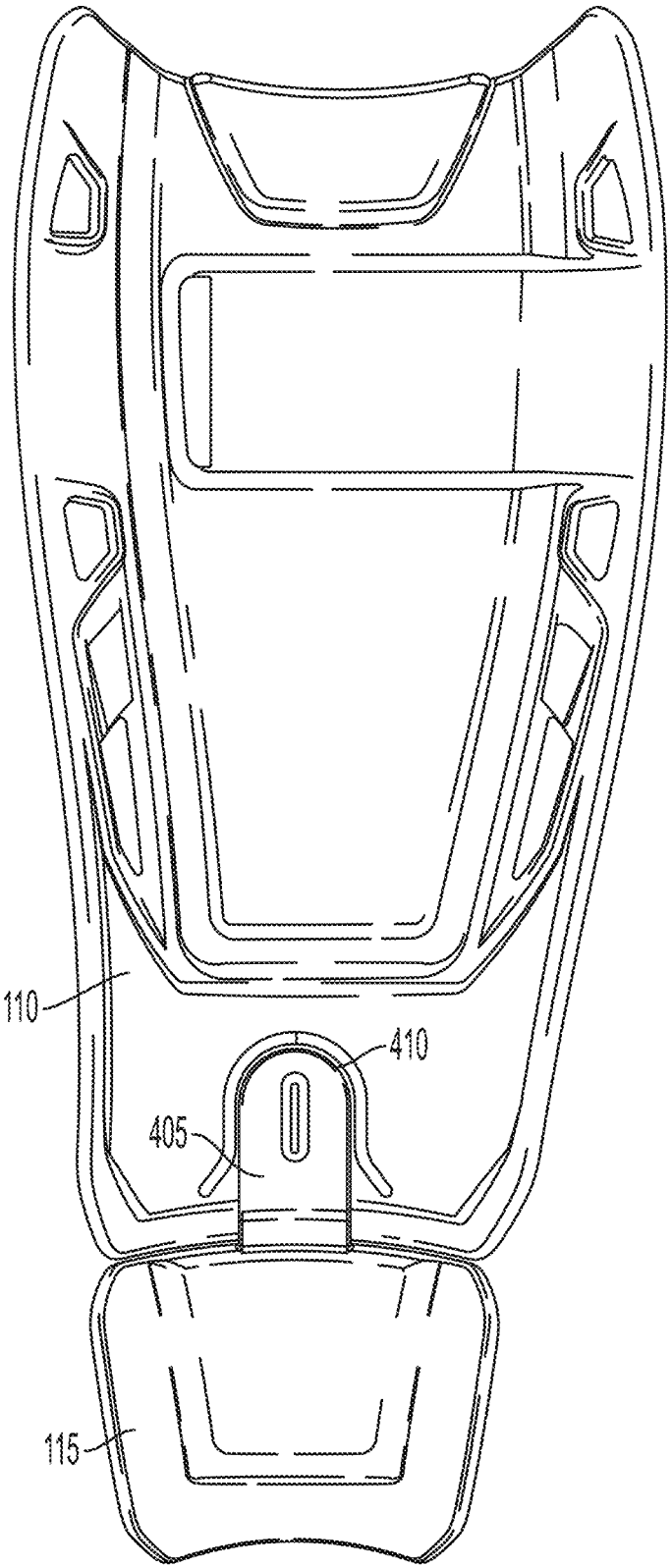
FIG. 7 is a posterior view of the shin cap and the shin-cap-extension element shown in FIG. 1, in accordance with embodiments of the present technology.
Figure 8:
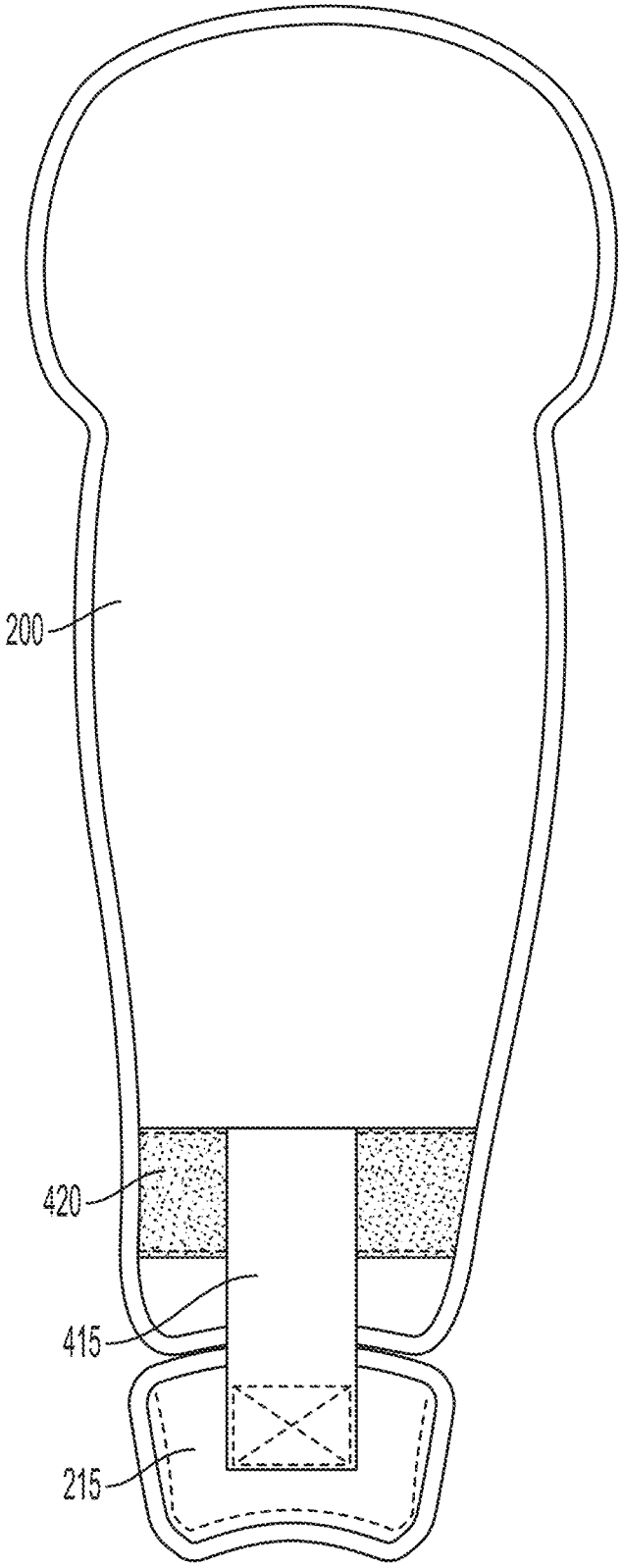
FIG. 8 is a posterior view of a shin-cap liner connected to a shin-cap-extension liner via liner-attachment elements.

FIG. 7 is a posterior view of the shin cap 110 and the shin-cap-extension element 115, in accordance with embodiments of the present technology. FIG. 7 shows the first cap-attachment element 405 (for example, the tab) engaged with and nested in the second cap-attachment element 410 (for example, the socket). FIG. 8 is a posterior view of the shin-cap liner 200 connected to the shin-cap-extension liner 215 via the first liner-attachment element 415 and the second liner-attachment element 420.

Leg guards and other protective equipment configured in accordance with embodiments of the present technology may be formed with any suitable materials, such as generally rigid materials (such as plastic materials or injection molded materials) for the caps 105, 110, 115, mesh or fabric or padded materials for the liners 200, 215, mesh or fabric or padded materials for the pads 205, 210, or other suitable materials for protecting a user's anatomy. In some embodiments, the shin-cap-extension element 115 may have a length (along a superior/upper to inferior/lower direction) of approximately 2.0 to 3.0 inches, or approximately 2.5 inches, or it may have other suitable dimensions, depending on the desired adjustability and configurability of the leg guard 100.

Guards and other protective equipment configured in accordance with embodiments of the present technology provide several advantages. For example, less tooling is needed to create multiple sizes of guards relative to existing technology, which improves production efficiency. In addition, two differently sized users may be able to wear the same guard by removing or adding the extension element according to size needs. Accordingly, guards configured in accordance with embodiments of the present technology are more versatile than existing equipment.

From the foregoing, it will be appreciated that specific embodiments of the disclosed technology have been described for purposes of illustration, but that various modifications may be made without deviating from the technology, and elements of certain embodiments may be interchanged with those of other embodiments, and that some embodiments may omit some elements. For example, although leg guards are described, embodiments of the present technology may be implemented in other protective equipment, such as arm guards. For example, an arm guard may have a cap extension that connects to a primary arm cap using an attachment mechanism similar to or the same as the attachment mechanism 400. Accordingly, the attachment mechanism 400 may be implemented in other devices and equipment.

Further, while advantages associated with certain embodiments of the disclosed technology have been described in the context of those embodiments, other embodiments may also exhibit such advantages, and not all embodiments need necessarily exhibit such advantages to fall within the scope of the technology. Accordingly, the disclosure and associated technology may encompass other embodiments not expressly shown or described herein, and the invention is not limited except as by the appended claims.

What is claimed is:

1. A leg guard comprising:

a shin cap configured to cover at least a portion of a user's anterior shin region; and a shin-cap-extension element configured to cover at least another portion of a user's anterior shin region;

wherein:

(a) the shin-cap-extension element comprises a tab element;

(b) the shin cap includes a contoured wall element that protrudes in a posterior direction from a posterior surface of the shin cap, wherein the contoured wall element forms a socket positioned to receive the tab element;

(c) the shin-cap-extension element is connectable to the shin cap and removable from the shin cap via the tab element and the socket; and (d) the shin-cap-extension element comprises a contoured projection shaped to engage a contoured notch on the shin cap to nest the shin-cap-extension element with the shin cap.

2. The leg guard of claim 1, wherein the tab element comprises a boss, and the shin cap comprises an opening positioned to receive the boss.

3. The leg guard of claim 2, wherein the opening extends through a full thickness of the shin cap.

4. The leg guard of claim 1, further comprising:

a shin-cap liner attached to the shin cap;

a shin-cap-extension liner attached to the shin-cap-extension element;

a first liner-attachment element on the shin-cap-extension liner; and a second liner-attachment element on the shin-cap liner.

5. The leg guard of claim 4, wherein the first liner-attachment element and the second liner-attachment element engage each other via hook and loop fasteners.

6. Protective equipment for protecting a portion of a user's body, the protective equipment comprising:

a cap configured to cover a first portion of a user's body; and a cap-extension element connectable to an end of the cap and configured to cover at least another portion of the user's body;

wherein:

(a) the cap-extension element is connectable to the cap and removable from the cap via an attachment mechanism;

(b) the attachment mechanism comprises a tab element and a socket element positioned to receive the tab element;

(c) the cap-extension element comprises the tab element;

(d) the cap comprises the socket element;

(e) the attachment mechanism comprises a boss attached to the tab element, wherein the boss projects in an anterior direction from an anterior surface of the tab element; and (f) the cap comprises an opening in the socket element, wherein the opening is positioned to receive the boss.

7. The protective equipment of claim 6, further comprising:

a cap liner attached to the cap;

a cap-extension liner attached to the cap-extension element;

a first liner-attachment element on the cap-extension liner; and a second liner-attachment element on the cap liner;

wherein the attachment mechanism comprises the first liner-attachment element and the second liner-attachment element.

8. The protective equipment of claim 7, wherein the first liner-attachment element and the second liner-attachment element engage each other via hook and loop fasteners.

9. The protective equipment of claim 6, wherein the protective equipment is a leg guard, and wherein the cap and the cap-extension element are each configured to protect a portion of a user's anterior shin region.

10. A leg guard comprising:

a shin cap configured to cover at least a first portion of a user's anterior shin region, wherein the shin cap comprises a wall element protruding along a posterior direction from the shin cap, the wall element forming a socket element;

a shin-cap liner attached to the shin cap;

a shin-cap-extension element configured to connect to an end of the shin cap and to cover at least a second portion of a user's anterior shin region that is inferior to the first portion; and a shin-cap-extension liner attached to the shin-cap-extension element;

wherein the shin-cap-extension element is removable from the shin cap and connectable to the shin cap via an attachment mechanism; and wherein the attachment mechanism comprises:

a tab element attached to the shin-cap-extension element and positioned to engage the socket element; and a first liner-attachment element attached to the shin-cap-extension liner and positioned to engage a second liner-attachment element attached to the shin-cap liner, wherein the first liner-attachment element comprises a strip of material extending along a superior direction from the shin-cap-extension liner.

11. The leg guard of claim 10, wherein the tab element comprises a boss and the shin cap comprises an opening positioned to receive the boss.

12. The leg guard of claim 10, wherein the first liner-attachment element and the second liner-attachment element engage each other via hook and loop fasteners.

13. The leg guard of claim 10, wherein, when the shin-cap-extension liner is attached to the shin cap, the shin-cap liner overlaps the shin-cap-extension liner, and the shin-cap-extension liner is positioned between the shin-cap liner and the shin-cap-extension element.

14. The leg guard of claim 10, further comprising a knee cap connected to the shin cap.

15. The leg guard of claim 10, wherein the attachment mechanism further comprises a boss attached to the tab element, wherein the boss projects in an anterior direction from an anterior surface of the tab element.

16. The leg guard of claim 15, wherein the shin cap comprises an opening in the socket element, wherein the opening is positioned to receive the boss.

17. The protective equipment of claim 6, wherein the cap comprises a wall element that protrudes from a surface of the cap, wherein the wall element forms the socket element.

18. The leg guard of claim 10, wherein the wall element forms an opening facing along an inferior direction opposite the superior direction.

19. A leg guard comprising:

a shin cap configured to cover at least a portion of a user's anterior shin region; and a shin-cap-extension element configured to cover at least another portion of a user's anterior shin region;

wherein:

(a) the shin-cap-extension element comprises a tab element;

(b) the shin cap includes a contoured wall element that protrudes in a posterior direction from a posterior surface of the shin cap, wherein the contoured wall element forms a socket positioned to receive the tab element; and (c) the shin-cap-extension element is connectable to the shin cap and removable from the shin cap via the tab element and the socket.

* * * * *